US007571973B2

(12) United States Patent
Hasseler

(10) Patent No.: US 7,571,973 B2
(45) Date of Patent: Aug. 11, 2009

(54) MONITORING FLUID SHORT CONDITIONS FOR FLUID-EJECTION DEVICES

(75) Inventor: Kelvin Hasseler, Murrieta, CA (US)

(73) Assignee: Hewlett-Packard Development Company, L.P., Houstion, TX (US)

( * ) Notice: Subject to any disclaimer, the term of this patent is extended or adjusted under 35 U.S.C. 154(b) by 930 days.

(21) Appl. No.: 10/393,881

(22) Filed: Mar. 22, 2003

(65) Prior Publication Data

US 2004/0183848 A1 Sep. 23, 2004

(51) Int. Cl.
*B41J 2/01* (2006.01)

(52) U.S. Cl. ..... 347/19; 347/5; 347/14

(58) Field of Classification Search ..... 347/5–9, 347/14–15, 19; 315/308
See application file for complete search history.

(56) References Cited

U.S. PATENT DOCUMENTS

| | | | | |
|---|---|---|---|---|
| 4,119,973 | A | 10/1978 | Stager | 347/77 |
| 6,002,215 | A * | 12/1999 | Yamashita et al. | 315/308 |
| 6,039,428 | A | 3/2000 | Juve | 347/19 |
| 6,276,777 | B1 * | 8/2001 | Schiaffino et al. | 347/17 |
| 6,292,018 | B1 * | 9/2001 | Kean | 326/41 |
| 6,318,828 | B1 * | 11/2001 | Barbour et al. | 347/9 |
| 6,364,475 | B2 | 4/2002 | Feinn et al. | 347/87 |
| 6,402,277 | B1 | 6/2002 | Monclus et al. | 347/7 |
| 6,454,378 | B1 * | 9/2002 | Silverbrook et al. | 347/19 |
| 2002/0175965 | A1 | 11/2002 | Skene et al. | 347/19 |
| 2003/0025740 | A1 | 2/2003 | Rehmann et al. | 347/5 |

FOREIGN PATENT DOCUMENTS

| | | |
|---|---|---|
| EP | 0593175 A2 | 4/1994 |
| EP | 0805028 A2 | 11/1997 |

OTHER PUBLICATIONS

European Search Report dated Jun. 21, 2004.

* cited by examiner

*Primary Examiner*—Lam S Nguyen

(57) ABSTRACT

A fluid short management assembly for a plurality of fluid-ejection devices of one embodiment of the invention is disclosed that includes one or more monitoring mechanisms and a controller. The monitoring mechanisms monitor one or more fluid short conditions for each fluid ejection device. The fluid short conditions are selected from the group essentially consisting of: an over-current condition, an over-voltage condition, and an over-temperature condition. The controller turns off those of the fluid-ejection devices failing any of the fluid short conditions without affecting other of the fluid ejection devices not failing any of the fluid short conditions.

28 Claims, 5 Drawing Sheets

200

210A
214A
PEN POWER CONTROL LINES
206A
TEMP MONITOR MECH
202
212A
PEN BUS 1
TO PEN
CURRENT AND VOLTAGE MONITOR MECHANISM
VOLTAGE SWITCH
204A
208A
218
DATA BUS
CONTROLLER
216A
PEN POWER LINE
216B
PEN POWER LINE
210B
208B
VOLTAGE SWITCH
204B
CURRENT AND VOLTAGE MONITOR MECHANISM
212B
PEN BUS 2
TO PEN
TEMP MONITOR MECH
206B
214B
PEN POWER CONTROL LINES

MONITORING FLUID SHORT CONDITIONS FOR FLUID-EJECTION DEVICES

BACKGROUND

A common type of image-forming device is the inkjet printer. An ink-jet printer usually includes an inkjet-printing mechanism having a number of ink-jet pens. The inkjet-printing mechanism is more generally a fluid-ejection mechanism, and the inkjet pens are more generally fluid-ejection devices. Ink-jet printers are commonly used in residential, office, and industrial environments. In industrial environments, an inkjet printer may be very heavy duty, and intended to print non-stop for hours at a time without interruption or user intervention.

The ink output by the inkjet pens of inkjet printers, and more generally the fluid output by fluid-ejection devices, is typically conductive. Because ink-jet printers are electronic devices, this can be problematic. If the ink, or fluid, reaches exposed electrical contacts, an ink, or fluid, short can result. An ink or fluid short is an electrical short circuit condition caused by ink or fluid. Inkjet pens and fluid-ejection devices are usually designed to reduce the potential for ink and fluid shorts to occur. However, even with the best of designs, ink and fluid shorts may still occur.

When ink or fluid shorts occur, many inkjet printers and other image-forming devices are designed to shut down all the inkjet pens or fluid-ejection devices. This prevents the ink or fluid shorts from causing undue damage to the inkjet printers or image-forming devices, and also prevents more serious problems, such as fire, from occurring. However, within industrial environments especially, shutting down all the inkjet pens or fluid-ejection devices can be economically undesirable, such as when a large print job is being performed.

SUMMARY OF THE INVENTION

A fluid short management assembly for a plurality of fluid-ejection devices of one embodiment of the invention includes one or more monitoring mechanisms and a controller. The monitoring mechanisms monitor one or more fluid short conditions for each fluid ejection device. The fluid short conditions are selected from the group essentially consisting of: an over-current condition, an over-voltage condition, and an over-temperature condition. The controller turns off those of the fluid-ejection devices failing any of the fluid short conditions without affecting other of the fluid ejection devices not failing any of the fluid short conditions.

BRIEF DESCRIPTION OF THE DRAWINGS

The drawings referenced herein form a part of the specification. Features shown in the drawing are meant as illustrative of only some embodiments of the invention, and not of all embodiments of the invention, unless explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Fluid Short Management Assembly or Mechanism

Figure 1:
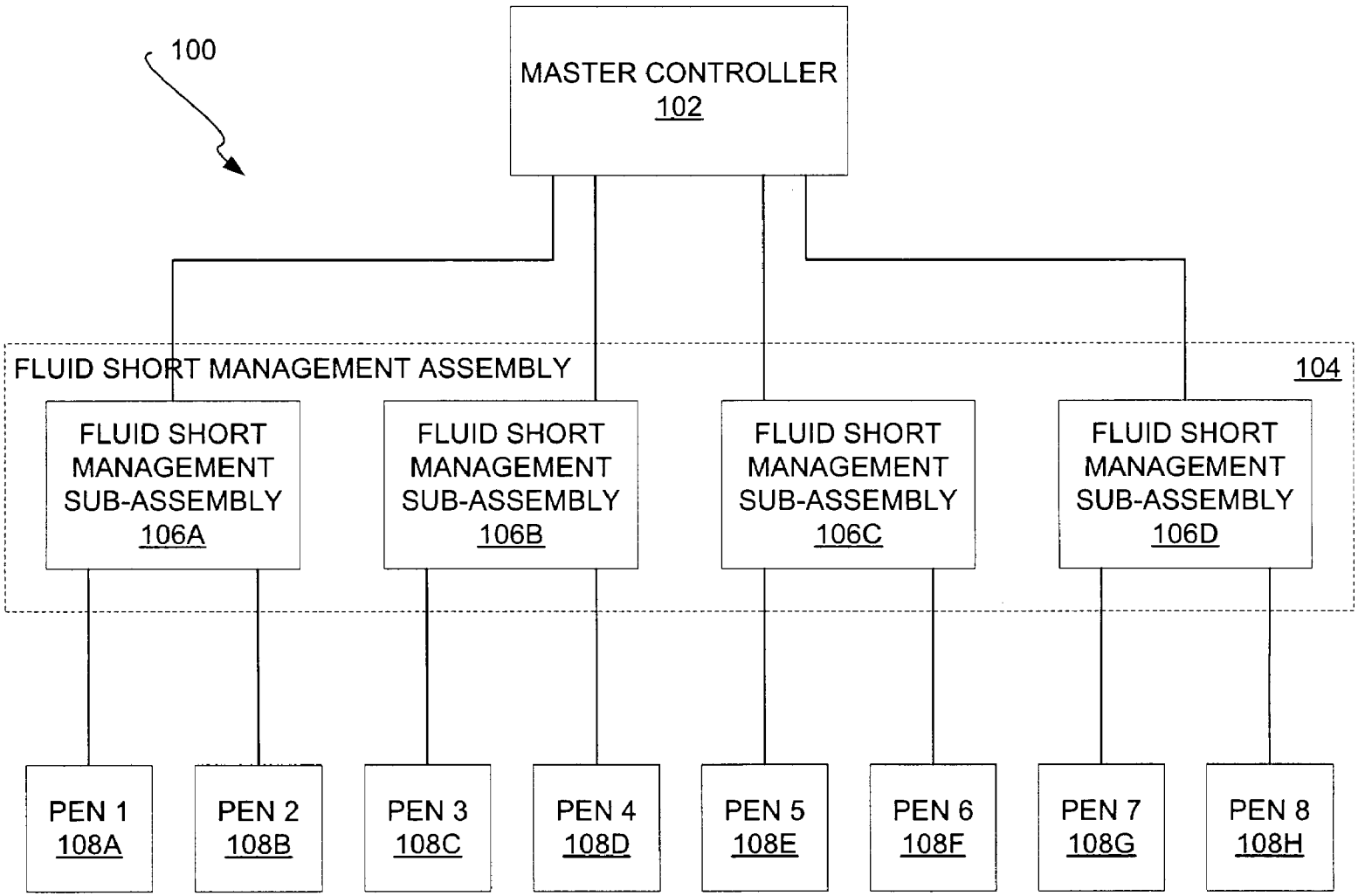
FIG. 1 is a partial diagram of an electrical control system for a fluid-ejection mechanism, according to an embodiment of the invention.

FIG. 1 partially shows an electrical control system 100 for a fluid-ejection mechanism, according to an embodiment of the invention. Only those components needed to implement an embodiment of the invention are depicted in FIG. 1, and other components may be included in addition to or in lieu of the components depicted in FIG. 1, as can be appreciated by those of ordinary skill within the art. The fluid-ejection mechanism may be part of an image-forming device, and may be an inkjet-printing mechanism that is part of an inkjet printer.

The system 100 includes a master controller 102 and a fluid short management assembly 104 that is communicatively connected to a number of inkjet pens 108A, 108B, 108C, 108D, 108E, 108F, 108G, and 108H, which are collectively referred to as the inkjet pens 108. The inkjet pens 108 are more generally fluid-ejection devices. The fluid short management assembly 104 may be an ink short management assembly. The fluid short management assembly 104 specifically includes fluid short management sub-assemblies 106A, 106B, 106C, and 106C, collectively referred to as the sub-assemblies 106. The sub-assembly 106A is communicatively connected to the pens 108A and 108B, the sub-assembly 106B is communicatively connected to the pens 108C and 108D, the sub-assembly 106C is communicatively connected to the pens 108E and 108F, and the sub-assembly 106D is communicatively connected to the pens 108H and 108H.

The master controller 102 is responsible for directly or indirectly controlling the output of fluid, or ink, by the inkjet pens 108. The master controller 102 is also responsible for monitoring the fluid short management assembly 104. The controller 102 may be software, hardware, or a combination of software and hardware. The fluid short management assembly 104 is responsible for monitoring the pens 108 for fluid short conditions, such as over-current conditions, over-voltage conditions, and over-temperature conditions that may indicate a fluid short has occurred. The assembly 104 may be software, hardware, or a combination of software and hardware. In one embodiment, the assembly 104 is a printed circuit assembly (PCA).

The fluid short management sub-assembly 106A specifically monitors the pens 108A and 108B for fluid short conditions, and is able to independently turn off either of the pens 108A and 108B in response to detecting such a condition. Similarly, the sub-assembly 106B monitors the pens 108C and 108D for fluid short conditions, and is able to independently turn off either of the pens 108C and 108D. The sub-assembly 106C monitors the pens 108E and 108F, and is able to independently turn off either of the pens 108E and 108F. Finally, the sub-assembly 106D monitors the pens 108G and 108H, and is able to independently turn off either of the pens 108G and 108H.

Figure 2:
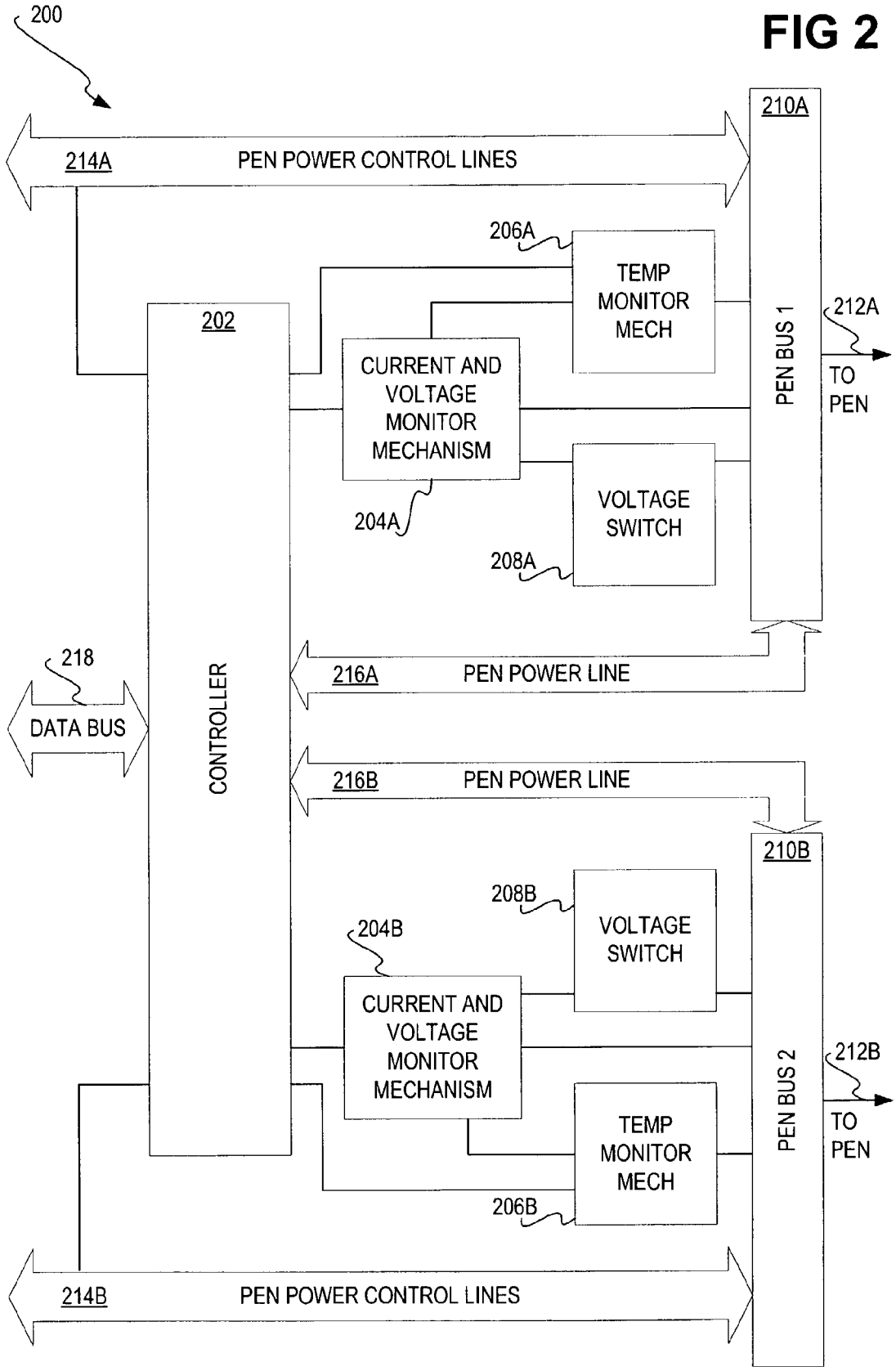
FIG. 2 is a diagram of a fluid short management sub-assembly, according to an embodiment of the invention.

FIG. 2 shows a fluid short management sub-assembly 200 in detail, according to an embodiment of the invention. The sub-assembly 200 may specifically implement any of the fluid short management sub-assemblies 106 of FIG. 1. The sub-assembly 200 may be an ink short management sub-assembly. The sub-assembly 200 includes a controller 202, which may be implemented in one embodiment as a field-programmable gate array (FPGA). The controller 202 thus may be classified as hard-coded logic for fire and safety control equipment. Alternatively, the controller 202 may be implemented as firmware, or another type of software. The sub-assembly 200 further includes fluid short monitoring mechanisms 204A and 206A for a first inkjet pen, or fluid-ejection device, and fluid short monitoring mechanisms 204B and 206B for a second inkjet pen, or fluid-ejection device.

The controller 202 communicates with the master controller 102 of FIG. 1 over a data bus 218. Pen power control lines 214A and 214B communicatively connect to pen buses 210A and 210B, where the pen bus 210A communicatively connects to the first inkjet pen, as indicated by the arrow 212A, and the pen bus 210B communicatively connects to the second inkjet pen, as indicated by the arrow 212B. Power is received by the pens specifically through the pen power lines 216A and 216B. The first pen power line 216A connects the controller 202 with the first pen bus 210A, whereas the second pen power line 216B connects the controller 202 with the second pen bus 210B.

The current and voltage monitoring mechanisms 204A and 204B monitor the first and the second inkjet pens, and monitor control logic signals and regulated power lines, for over-current and over-voltage conditions. The mechanisms 204A and 204B are communicatively connected to the pen buses 210A and 210B, respectively, and the controller 202. An over-current condition occurs where an inkjet pen, or fluid-ejection device, has more than a normal amount of current flowing therethrough, whereas an over-voltage current condition occurs where an inkjet pen, or fluid-ejection device, has more than a normal amount of voltage thereover. For instance, an over-current condition may occur where the operating current exceeds an average operating current by more than a threshold, whereas an over-voltage condition may occur where the operating voltage exceeds an average operating voltage by more than a threshold. Either condition is indicative that an ink, or fluid or electrical, short has occurred at the pen, or fluid-ejection device.

In response to detecting that their associated inkjet pens are suffering from an over-current or over-voltage condition, the mechanisms 204A and 204B report faults to the controller 202. In response, the controller 202 is able to turn off power specifically from the faulty pens, based on printing status and fault type, for instance. This shutdown is preferably accomplished in a manner that ensures safety to the pen, the controller 202, and any present electronics or fluid-delivery plastics, to eliminate the possibility of fire. Shutdown for the purpose of fire protection may also be the responsibility of the master controller 102. The controller 202 may be given a fault type, on which basis the controller 202 decides to shut down the pen and the remaining power in a safe and controlled manner. The controller 202 is preferably designed to function as a fire-suppressant controller even in the event of the master controller 102 becoming non-operative or non-logical.

If the first inkjet pen has failed either the over-current or over-voltage condition, then the controller 202 is able to turn off this pen without affecting, or turning off, the second inkjet pen, and vice-versa. The mechanisms 204A and 204B may be implemented as electronic circuits in one embodiment. Whereas the embodiment of FIG. 2 has a single mechanism for monitoring over-voltage and over-current conditions for each inkjet pen, alternatively there may be one mechanism for monitoring over-voltage, and another mechanism for monitoring over-current. The mechanisms 204A and 204B are also communicatively connected to voltage switches 208A and 208B, respectively, which are connected to the first and the second pens to control the amount of voltage received by the pens.

The temperature monitoring mechanisms 206A and 206B monitor the first and the second inkjet pens for an over-temperature condition, and are communicatively connected to the pen buses 210A and 210B, respectively, the mechanisms 204A and 204B, respectively, and the controller 202. An over-temperature condition occurs where an inkjet pen, or fluid-ejection device, has an operating temperature that exceeds nominal conditions. For instance, an over-temperature condition may occur when the operating temperature exceeds a threshold temperature. The over-temperature condition is indicative that an ink, or fluid, short has occurred at the pen, or fluid-ejection device. The controller 202 is designed to function even if the fluid-ejection device or inkjet pen has on-board thermal shut-off, acting as a fail-safe backup system for the safety of equipment and personnel.

In response to detecting that their associated inkjet pens are suffering from an over-temperature condition, the mechanisms 206A and 206B report faults to the controller 202. In response, the controller 202 is able to turn off power from the faulty pens. If the first inkjet pen has failed the over-temperature condition, then the controller 202 is able to turn off this pen without affecting, or turning off, the second inkjet pen, and vice-versa. The mechanisms 206A and 206B may be implemented as electronic circuits in one embodiment. The mechanisms 204A and 204B are communicatively connected to the mechanisms 206A and 206B in one embodiment of the invention.

The controller 202 is operable in three different modes. In an operation mode of the controller 202, the inkjet pens connected to the pen buses 210A and 210B are operating normally and without fault, insofar as ink or fluid shorts are concerned. In a configuration mode of the controller 202, condition thresholds are set for one or more of the over-current, over-voltage, and over-temperature conditions. These thresholds indicate at what current, voltage, and temperature the over-current, over-voltage, and over-temperature conditions occur. In a fault mode of the controller 202, at least one of the pens connected to the buses 210A and 210B has failed one of the ink or fluid short conditions, such that the failing pens have been turned off. The controller 202 may also turn off either of the inkjet pens, or fluid-ejection devices, that fail a continuity fluid short condition, in which an inkjet pen does not have constant electrical connection continuity.

Methods

Figure 3:
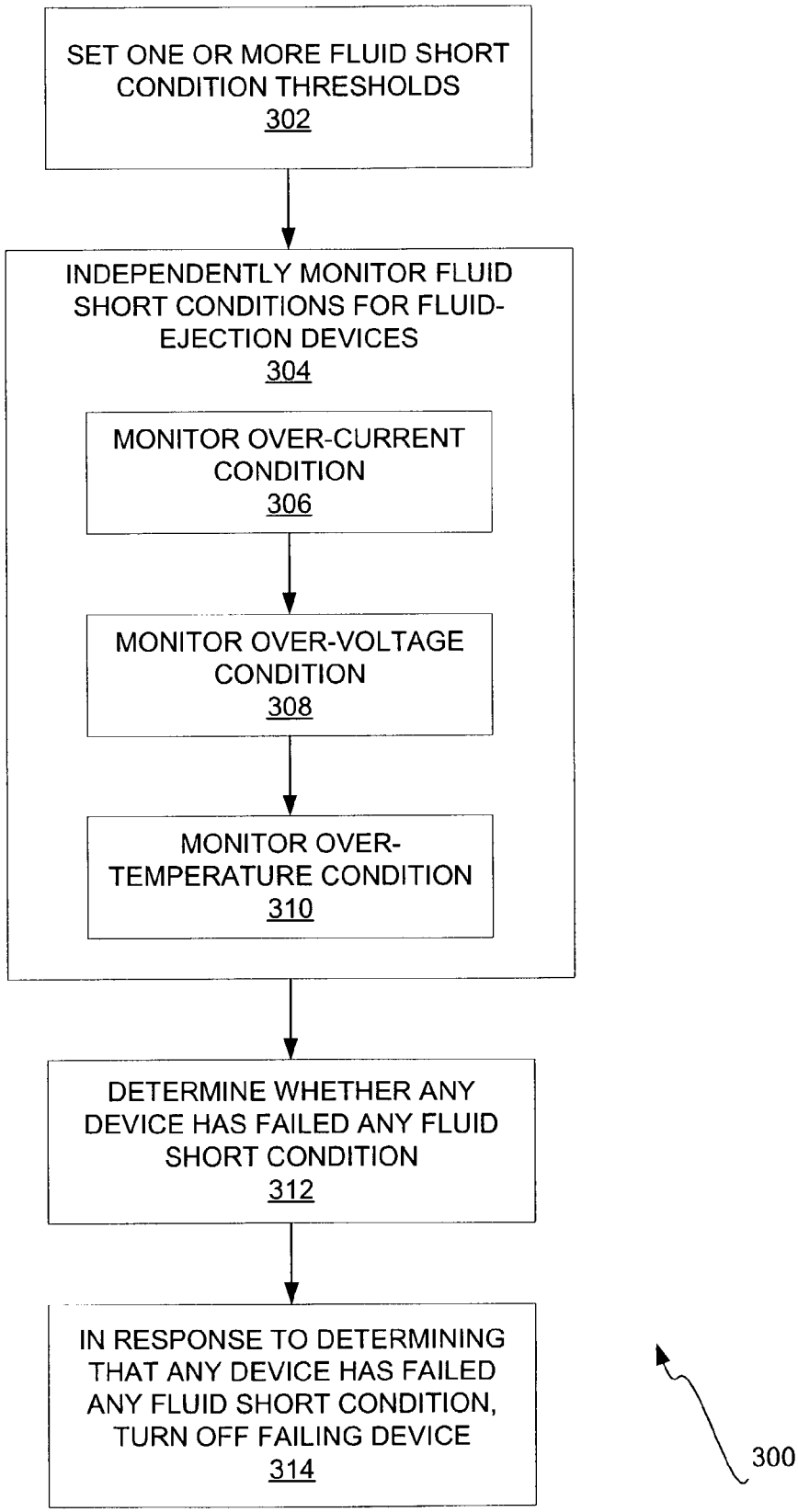
FIG. 3 is a flowchart of an overall method for monitoring fluid short conditions, according to an embodiment of the invention.

FIG. 3 shows an overall method 300 for monitoring fluid short conditions of fluid-ejection devices, such as inkjet pens, according to an embodiment of the invention. The method 300 is depicted in FIG. 3 as being sequentially performed. However, this is for the sake of illustrative and descriptive clarity, and in actuality parts of the method 300 may be performed in parallel with one another, or in a different order than that depicted in FIG. 3. The method 300 may be performed by the fluid short assembly 104 of FIG. 1 and/or by the fluid short sub-assembly 200 of FIG. 2. The method 300 may also more specifically be performed by the controller 202 and the fluid short monitoring mechanisms 204A, 204B, 206A, and 206B of FIG. 2. The method 300 may be implemented as one or more computer programs stored on a computer-readable medium. The medium may be a volatile or a non-volatile medium, a fixed or a removable medium, and a magnetic, solid-state, and/or optical medium.

One or more fluid short condition thresholds optionally may be initially set (302). The thresholds may be set in a configuration mode. Such thresholds are used to determine whether a fluid-ejection device has failed a fluid short condition, such as an over-current condition, an over-voltage condition, or an over-temperature condition. The fluid-ejection devices are independently monitored for these fluid short conditions (304). Specifically, they are independently monitored for a fluid short over-current condition (306), a fluid short over-voltage condition (308), and a fluid short over-temperature condition (310). For instance, such monitoring may be accomplished as has been described in conjunction with FIG. 2. The monitoring may occur in an operation mode.

The method 300 next determines whether any of the fluid-ejection devices has failed one or more of the fluid short conditions (312). In response to determining that any of the fluid-ejection devices has failed one or more of the fluid short conditions, the failing devices in question are turned off (314). This can be accomplished as has been described in conjunction with FIG. 2. The failing devices are turned off without affecting the other, non-failing fluid-ejection devices. That is, the failing devices are turned off without turning off the non-failing devices. Thus, the other devices may remain running, and may continue to eject fluid in accordance with a print job, for instance. Once any of the devices have been turned off, a fault mode may be entered.

Figure 4:
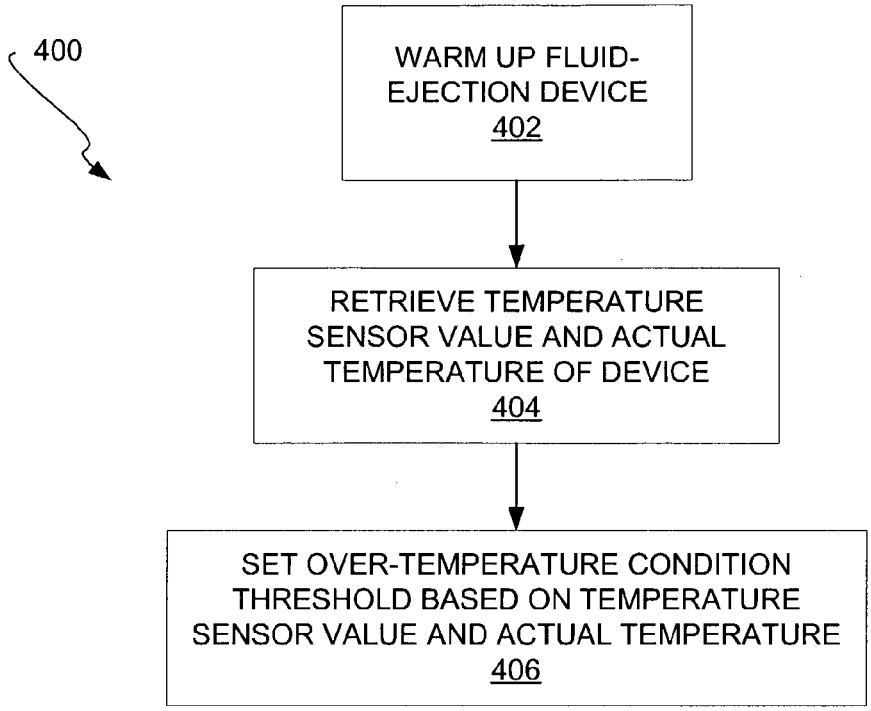
FIG. 4 is a flowchart of a specific method to determine an over-temperature condition threshold, according to an embodiment of the invention.

FIG. 4 shows a specific method 400 for determining an over-temperature condition threshold in a configuration mode, according to an embodiment of the invention. The method 400 may be performed as part of 302 of the method 300 of FIG. 3 in one embodiment of the invention. Like the method 300, the method 400 may be performed by the fluid short assembly 104 of FIG. 1 and/or by the fluid short sub-assembly 200 of FIG. 2. The method 400 may also more specifically be performed by the controller 202 and the fluid short monitoring mechanisms 206A and 206B of FIG. 2. The method 400 may be performed in conjunction with precision or non-precision sensor devices, such as a temperature-sensing resistor (TSR). Like the method 300, the method 400 may be implemented as one or more computer programs stored on a computer-readable medium. The method 400 is specifically performed for each fluid-ejection device, or inkjet pen.

The fluid-ejection device is first warmed up for a length of time (402), until it has reached a nominal operating temperature. A temperature sensor value and the actual temperature of the device are then retrieved (404). The temperature sensor, for instance, may be part of the mechanisms 206A and 206B of FIG. 2. The actual temperature of the device may be the a priori known temperature that the device is operating at when having warmed up, whereas the temperature sensor value may be an n-bit value that corresponds to this temperature. The over-temperature condition threshold is then set as the sensor value for a given fault-point temperature based on the temperature sensor value and the actual temperature (406). That is, the over-temperature condition threshold is algebraically determined based on the a priori known temperature that the device is operating at which having warmed up, the sensor value at this temperature, and the given or desired fault-point temperature.

In another embodiment, two temperature sensor values and two actual temperatures are retrieved in 404, by obtaining a first sensor value at a first known temperature, and then by obtaining a second sensor value after causing the device to eject fluid to further warm up to a second known temperature. The threshold in 406 is algebraically determined based on the first and second known temperatures, the first and second sensor values, and the fault-point temperature. Thus, in 310 and 312 of the method 300 of FIG. 3, the over-temperature condition is monitored for a fluid-ejection device, and the fluid-ejection device is determined to have failed the over-temperature condition, when the corresponding temperature sensor value reaches the threshold set in 406.

Figure 5:
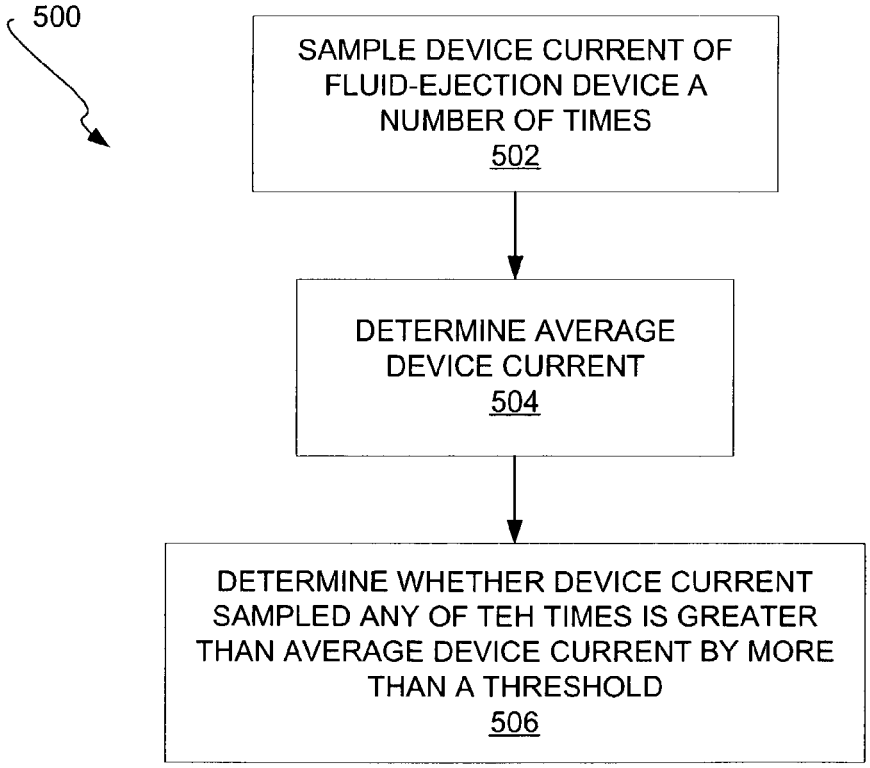
FIG. 5 is a flowchart of a specific method to determine whether a fluid-ejection device has failed a fluid short over-current condition, according to an embodiment of the invention.

FIG. 5 shows a specific method 500 for determining whether a fluid-ejection device has failed a fluid short over-current condition, according to an embodiment of the invention. The method 500 may be performed as part of 306 and/or 312 of the method 300 of FIG. 3 in one embodiment of the invention. Like the method 300, the method 500 may be performed by the fluid short assembly 104 of FIG. 1 and/or by the fluid short sub-assembly 200 of FIG. 2. The method 500 may also more specifically be performed by the controller 202 and the fluid short monitoring mechanisms 204A and 204B of FIG. 2. Like the method 300, the method 500 may be implemented as one or more computer programs stored on a computer-readable medium. The method 500 is specifically performed for each fluid-ejection device, or inkjet pen.

The device current of the fluid-ejection device is sampled a number of times (502), such as three or more times, to reduce the effect of any unwanted noise. Digital filtering may also be accomplished to reduce unwanted noise. The average device current is then determined (504), by averaging the device current as has been sampled the number of times. The method 500 determines whether any specific instance, or sampling, of the device current exceeds the average device current by more than a threshold, such as five percent (506). If so, then it is concluded that the fluid-ejection device has failed the over-current condition, such that a fluid short may have occurred.

For example, the device current at a particular print mode or fluid-movement condition of the fluid-ejection device may be sampled three times, yielding currents of i, 1.04i, and 1.15i. The average current is thus 3.19i divided by three, or 1.06i. The current 1.15i exceeds the current 1.06i by more than seven percent. Where the over-current condition threshold is five percent, this means that the fluid-ejection device has failed the over-current condition, such that a fluid short may have occurred. The method 500 is thus able to predict a possible fluid-leak failure even where the amount of the leak is small and the current does not exceed a maximum allowable current, but otherwise surpasses the over-current threshold.

Figure 6:
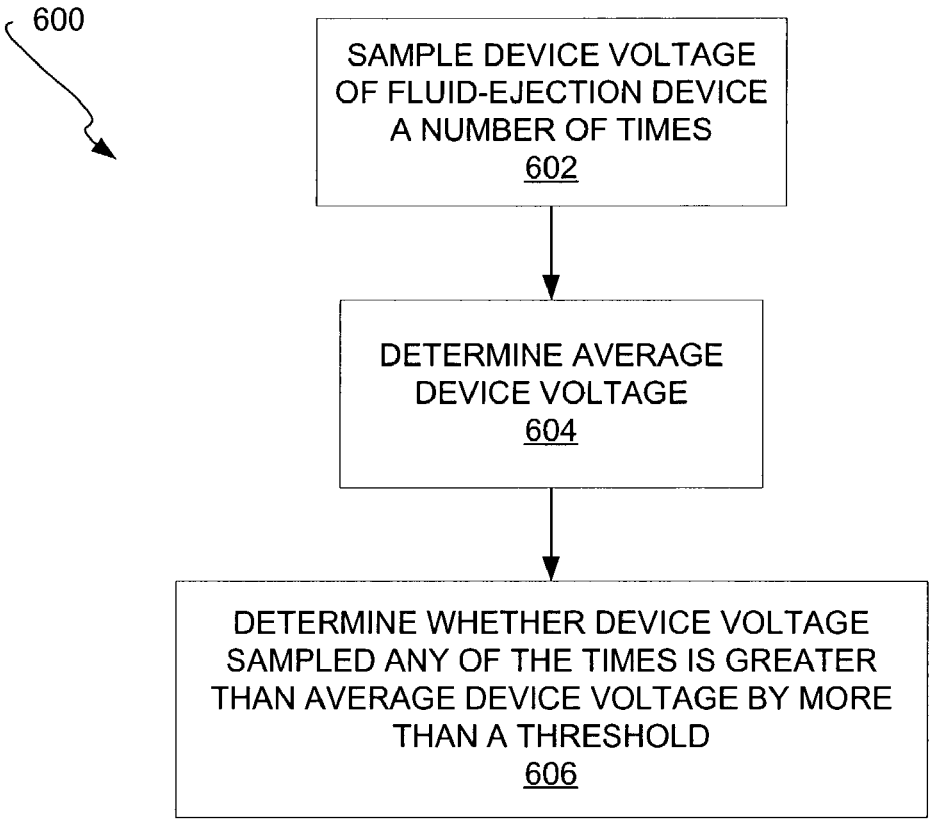
FIG. 6 is a flowchart of a specific method to determine whether a fluid-ejection device has failed a fluid short over-voltage condition, according to an embodiment of the invention.

FIG. 6 shows a similar specific method 600 for determining whether a fluid-ejection device has failed a fluid short over-voltage condition, according to an embodiment of the invention. The method 600 may be performed as part of 308 and/or 312 of the method 300 of FIG. 3 in one embodiment of the invention. Like the method 300, the method 600 may be performed by the fluid short assembly 104 of FIG. 1 and/or by the fluid short sub-assembly 200 of FIG. 2. The method 600 may also more specifically be performed by the controller 400 and the fluid short monitoring mechanisms 204A and 204B of FIG. 2. Like the method 300, the method 600 may be implemented as one or more computer programs stored on a computer-readable medium. The method 600 is specifically performed for each fluid-ejection device, or inkjet pen.

The device voltage of the fluid-ejection device is sampled a number of times (602), such as three or more times. The average device voltage is then determined (604), by averaging the device voltage as has been sampled the number of times. The method 600 determines whether any specific instance, or sampling, of the device voltage exceeds the average device voltage by more than a threshold, such as five percent (606). If so, then it is concluded that the fluid-ejection device has failed the over-voltage condition, such that a fluid short may have occurred.

Image-Forming Device

Figure 7:
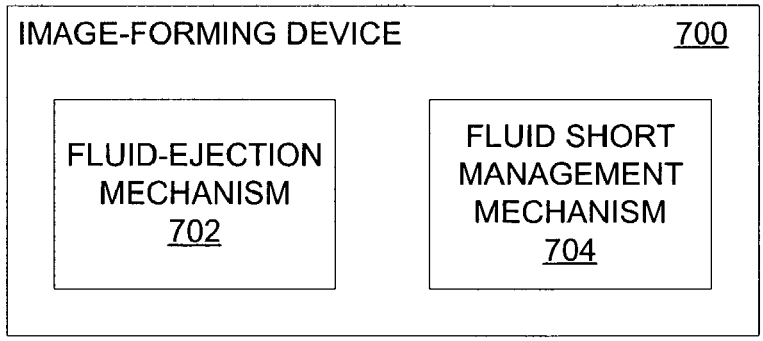
FIG. 7 is a block diagram of an image-forming device, according to an embodiment of the invention.

FIG. 7 shows an image-forming device 700, according to an embodiment of the invention. The image-forming device 700 may be an inkjet printer, or another type of image-forming device. The image-forming device 700 may include components other than and/or in addition to those depicted in FIG. 7, as can be appreciated by those of ordinary skill within the art. As shown in FIG. 7, the image-forming device 700 includes a fluid-ejection mechanism 702 and a fluid short management mechanism 704.

The fluid-ejection mechanism 702 includes a number of fluid-ejection devices. The fluid-ejection mechanism 702 may be an inkjet-printing mechanism, such that the fluid-ejection devices are inkjet pens. For instance, in one embodiment the fluid-ejection mechanism 702 can include the inkjet pens 108 of FIG. 1 that have been described.

The fluid short management mechanism 704 independently monitors and manages the fluid-ejection devices of the fluid-ejection mechanism 702 for fluid short conditions. The fluid short conditions can include over-current, over-voltage, and over-temperature conditions, as have been described. The fluid short management mechanism 704 can be or include the fluid short management assembly 104 of FIG. 1. The management mechanism 704 can include the fluid short management sub-assemblies 106 of FIG. 1, a specific embodiment of which has been described as the sub-assembly 200 of FIG. 2.

The fluid short management mechanism 704 may thus include monitoring mechanisms like the monitoring mechanism 204A, 204B, 206A, and 206B of FIG. 2, as well as the controller 202 of FIG. 2. In one embodiment, the management mechanism 704 may include the assembly 104 as a printed circuit assembly (PCA), and a number of instances of the monitoring mechanisms 204A, 204B, 206A, and 206B as monitoring circuits situated on the PCA. In this embodiment, the management mechanism 704 may also include a number of instances of the controller 202 as field-programmable gate arrays (FPGA's) situated on the PCA.

CONCLUSION

It is noted that, although specific embodiments have been illustrated and described herein, it will be appreciated by those of ordinary skill in the art that any arrangement that is calculated to achieve the same purpose may be substituted for the specific embodiments shown. Other applications and uses of embodiments of the invention, besides those described herein, are amenable to at least some embodiments. This application is intended to cover any adaptations or variations of the present invention. Therefore, it is manifestly intended that this invention be limited only by the claims and equivalents thereof.

I claim:

1. A fluid short management assembly for a plurality of fluid-ejection devices organized into a plurality of pairs of fluid-ejection devices comprising:

one or more monitoring mechanisms to monitor one or more fluid short conditions for each of the plurality of fluid-ejection devices selected from the group essentially consisting of a fluid short over-current condition by sampling device current of the fluid-ejection device a plurality of times, determining an average device current based on the device current sampled the plurality of times, and determining whether the device current sampled any of the plurality of times is greater than the average device current by more than a threshold; a fluid short over-voltage condition by sampling device voltage of the fluid-ejection device a plurality of times, determining an average device voltage based on the device voltage sampled the plurality of times, and determining whether the device voltage sampled any of the plurality of times is greater than the average device voltage by more than a threshold; and, a fluid short over-temperature condition; and, a controller comprising a sub-controller for each of the pairs of fluid-ejection devices to turn off any fluid-ejection device of the pair of fluid-ejection devices failing any of the one or more fluid short conditions without affecting any other of the plurality of fluid-ejection devices of the pair of fluid-ejection devices not failing any of the one or more fluid short conditions.

2. The fluid short management assembly of claim 1, wherein the one or more monitoring mechanisms comprises an over-current condition monitoring mechanism for each of the plurality of fluid-ejection devices to monitor the over-current condition for the fluid-ejection device.

3. The fluid short management assembly of claim 1, wherein the one or more monitoring mechanisms comprises an over-voltage condition monitoring mechanism for each of the plurality of fluid-ejection devices to monitor the over-voltage condition for the fluid-ejection device.

4. The fluid short management assembly of claim 1, wherein the one or more monitoring mechanisms comprises an over-current condition and over-voltage condition monitoring mechanism for each of the plurality of fluid-ejection devices to monitor the over-current condition and the over-voltage condition for the fluid-ejection device.

5. The fluid short management assembly of claim 1, wherein the one or more monitoring mechanisms comprises an over-temperature condition monitoring mechanism for each of the plurality of fluid-ejection devices to monitor the over-temperature condition for the fluid-ejection device.

6. The fluid short management assembly of claim 1, wherein each monitoring mechanism for each of the plurality of fluid-ejection devices generates a fault reportable to the controller when the fluid-ejection device fails the fluid short condition monitored by the monitoring mechanism.

7. The fluid short management assembly of claim 1, wherein the controller further turns off those of the plurality of fluid-ejection devices failing a continuity fluid short condition.

8. The fluid short management assembly of claim 1, wherein the controller has an operation mode in which the plurality of fluid-ejection devices are operating without fault, a configuration mode in which condition thresholds for at least one of the one or more monitoring mechanisms are set, and a fault mode in which at least one of the plurality of fluid-ejection devices has failed any of the one or more fluid short conditions.

9. The fluid short management assembly of claim 1, wherein the fluid short management assembly is a printed circuit assembly (PCA), each monitoring mechanism is a circuit, and the controller comprises a field-programmable gate array (FPGA).

10. The fluid short management assembly of claim 1, wherein the plurality of fluid-ejection devices is a plurality of inkjet pens, such that the fluid short management assembly is an ink short management assembly.

11. A fluid short management sub-assembly for a pair of fluid-ejection devices comprising:

a plurality of monitoring mechanisms to monitor a fluid short over-current condition by sampling device current a plurality of times, determining an average device current, and determining whether the device current sampled any of the plurality of times is greater than the average device current by more than a threshold; a fluid short over-voltage condition by sampling device voltage a plurality of times, determining an average device voltage, and determining whether the device voltage sampled any of the plurality of times is greater than the average device voltage by more than a threshold; and a fluid short over-temperature condition, for each of the pair of fluid-ejection devices; and, a controller to turn off any of the pair of fluid-ejection devices failing any of the fluid short conditions without affecting any of the pair of fluid-ejection devices not failing any of the fluid short conditions.

12. The fluid short management sub-assembly of claim 11, wherein the plurality of monitoring mechanisms comprises an over-current monitoring mechanism for each fluid-ejection device to determine whether the fluid-ejection device has an operating current exceeding an average operating current by more than a threshold.

13. The fluid short management sub-assembly of claim 11, wherein the plurality of monitoring mechanisms comprises an over-voltage monitoring mechanism for each fluid-ejection device to determine whether the fluid-ejection device has an operating voltage exceeding an average operating voltage by more than a threshold.

14. The fluid short management sub-assembly of claim 11, wherein the plurality of monitoring mechanisms comprises an over-temperature monitoring mechanism for each fluid-ejection device to determine whether the fluid-ejection device has an operating temperature exceeding a threshold temperature.

15. The fluid short management sub-assembly of claim 11, wherein the fluid short management sub-assembly is part of a printed circuit assembly (PCA), each monitoring mechanism is a circuit, and the controller comprises a field-programmable gate array (FPGA).

16. A method comprising:

for each of a plurality of fluid-ejection devices, independently monitoring a fluid short over-current condition;

monitoring a fluid short over-voltage condition;

monitoring a fluid short over-temperature condition; and, at least one of:

determining whether any of the plurality of fluid-ejection devices has failed the fluid short over-current condition by sampling device current of the fluid-ejection device a plurality of times, determining an average device current of the fluid-ejection device based on the device current sampled the plurality of times, and determining whether the device current sampled any of the plurality of times is greater than the average device current by more than a threshold;

determining whether any of the plurality of fluid-ejection devices has failed the fluid short over-voltage condition by sampling device voltage of the fluid-ejection device a plurality of times, determining an average device voltage of the fluid-ejection device based on the device voltage sampled the plurality of times, and determining whether the device voltage sampled any of the plurality of times is greater than the average device voltage by more than a threshold; and, in response to determining that any of the plurality of fluid-ejection devices has failed any of the fluid short over-current, over-voltage, and over-temperature conditions, turning off those of the plurality of fluid-ejection devices that have failed any of the conditions without affecting other of the plurality of fluid-ejection devices.

17. The method of claim 16, further initially comprising setting an over-temperature condition threshold in a configuration mode.

18. The method of claim 17, wherein setting the over-temperature condition threshold comprises, for each of the fluid-ejection devices:

warming up the fluid-ejection device;

retrieving a temperature sensor value and an actual temperature of the fluid-ejection device; and, setting the over-temperature condition threshold based on the temperature sensor value and the actual temperature of the fluid-ejection device.

19. The method of claim 16, wherein monitoring the fluid short over-current, over-voltage, and over-temperature conditions occurs within an operation mode.

20. The method of claim 16, wherein turning off those of the plurality of fluid-ejection devices that have failed any of the conditions occurs within a fault mode.

21. An image-forming device comprising:

a fluid-ejection mechanism having a plurality of fluid-ejection devices; and, a fluid short management mechanism to independently monitor and manage the plurality of fluid-ejection devices for one or more fluid short conditions selected from the group essentially consisting of a fluid short over-current condition, monitoring of which is accomplished by sampling device current a plurality of times, determining an average device current, and determining whether the device current sampled any of the plurality of times is greater than the average device current by more than a threshold; and, a fluid short over-voltage condition, monitoring of which is accomplished by sampling device voltage a plurality of times, determining an average device voltage, and determining whether the device voltage sampled any of the plurality of times is greater than the average device voltage by more than a threshold.

22. The image-forming device of claim 21, wherein the fluid-ejection mechanism comprises an inkjet-printing mechanism having a plurality of inkjet pens.

23. The image-forming device claim 21, wherein the fluid short management mechanism comprises:

one or more monitoring mechanisms for each of the fluid-ejection devices to monitor the one or more fluid short conditions; and, a controller to turn off those of the plurality of fluid-ejection devices failing any of the one or more fluid short conditions without turning off other of the plurality of fluid-ejection devices not failing any of the one or more fluid short conditions.

24. The image-forming device of claim 21, wherein the fluid short management mechanism comprises:

a printed circuit assembly;

a plurality of monitoring circuits situated on the printed circuit assembly, each of the circuits monitoring at least one of the one or more fluid short conditions for one of the plurality of fluid-ejection devices; and, a plurality of field-programmable gate arrays (FPGA's), each FPGA situated on the printed circuit assembly, communicatively coupled to a pair of the plurality of monitoring circuits that the FPGA manages for the one or more fluid short conditions.

25. An image-forming device comprising:

a fluid-ejection mechanism having a plurality of fluid-ejection devices organized into a plurality of pairs of fluid-ejection devices;

means for independently monitoring and managing the plurality of fluid-ejection devices for one or more fluid short conditions selected from the group essentially consisting of a fluid short over-current condition by sampling device current of the fluid-ejection device a plurality of times, determining an average device current based on the device current sampled the plurality of times, and determining whether the device current sampled any of the plurality of times is greater than the average device current by more than a threshold; a fluid short over-voltage condition by sampling device voltage of the fluid-ejection device a plurality of times, determining an average device voltage based on the device voltage sampled the plurality of times, and determining whether the device voltage sampled any of the plurality of times is greater than the average device voltage by more than a threshold; and a fluid short over-temperature condition; and, means for each of the pairs of fluid ejection-devices for turning off any fluid-ejection device of the pair of fluid-ejection devices failing any of the one or more fluid short conditions without affecting any other of the pair of fluid-ejection devices not failing any of the one or more fluid short conditions.

26. The image-forming device claim 25, wherein the fluid-ejection mechanism comprises an inkjet-printing mechanism having a plurality of inkjet pens.

27. An image-forming device comprising:

a fluid-ejection mechanism having a plurality of fluid-ejection devices;

a printed circuit assembly;

a plurality of monitoring circuits situated on the printed circuit assembly, each of the circuits monitoring at least one fluid short condition for one of the plurality of fluid-ejection devices, the fluid short conditions selected from the group essentially consisting of a fluid short over-current condition by sampling device current of the fluid-ejection device a plurality of times, determining an average device current based on the device current sampled the plurality of times, and determining whether the device current sampled any of the plurality of times is greater than the average device current by more than a threshold; a fluid short over-voltage condition by sampling device voltage of the fluid-ejection device a plurality of times, determining an average device voltage based on the device voltage sampled the plurality of times, and determining whether the device voltage sampled any of the plurality of times is greater than the average device voltage by more than a threshold; and a fluid short over-temperature condition; and, a plurality of field-programmable gate arrays (FPGA's), each FPGA situated on the printed circuit assembly, communicatively coupled to a pair of the plurality of monitoring circuits that the FPGA manages for the at least one fluid short condition.

28. The image-forming device of claim 27, wherein the fluid-ejection mechanism comprises an inkjet-printing mechanism having a plurality of inkjet pens.

* * * * *

UNITED STATES PATENT AND TRADEMARK OFFICE

CERTIFICATE OF CORRECTION

PATENT NO. : 7,571,973 B2
APPLICATION NO. : 10/393881
DATED : August 11, 2009
INVENTOR(S) : Kelvin Hasseler It is certified that error appears in the above-identified patent and that said Letters Patent is hereby corrected as shown below:

In column 8, line 8, in Claim 1, delete "of" and insert -- of: --, therefor.

In column 9, lines 58-59, in Claim 16, after "condition;" delete "and,".

In column 10, line 45, in Claim 21, delete "of" and insert -- of: --, therefor.

In column 10, line 61, in Claim 23, after "device" insert -- of --.

In column 11, line 23, in Claim 25, delete "of" and insert -- of: --, therefor.

In column 12, line 5, in Claim 26, after "device" insert -- of --.

In column 12, line 16, in Claim 27, delete "of" and insert -- of: --, therefor.

Signed and Sealed this

Thirteenth Day of July, 2010

David J. Kappos

David J. Kappos
*Director of the United States Patent and Trademark Office*